US008131190B2

(12) United States Patent
Masubuchi

(10) Patent No.: US 8,131,190 B2
(45) Date of Patent: Mar. 6, 2012

(54) MAGNETIC ROLLER, DEVELOPMENT DEVICE, AND IMAGE FORMING METHOD

(75) Inventor: Fumihito Masubuchi, Ebina (JP)

(73) Assignee: Ricoh Company Limited, Tokyo (JP)

( * ) Notice: Subject to any disclaimer, the term of this patent is extended or adjusted under 35 U.S.C. 154(b) by 681 days.

(21) Appl. No.: 12/262,895

(22) Filed: Oct. 31, 2008

(65) Prior Publication Data

US 2009/0110441 A1 Apr. 30, 2009

(30) Foreign Application Priority Data

Oct. 31, 2007 (JP) ..... 2007-282909
Aug. 1, 2008 (JP) ..... 2008-199211

(51) Int. Cl.
*G03G 15/09* (2006.01)

(52) U.S. Cl. ..... 399/276; 399/229; 399/275; 399/277

(58) Field of Classification Search ..... 399/229, 399/275, 276, 277
See application file for complete search history.

(56) References Cited

U.S. PATENT DOCUMENTS 3,828,730 A * 8/1974 Yamashita et al. ..... 399/273
4,067,296 A * 1/1978 Sessink ..... 399/276
4,354,454 A * 10/1982 Nishikawa ..... 399/277
7,139,518 B2 11/2006 Masubuchi
2002/0009312 A1* 1/2002 Sugimoto et al. ..... 399/270
2002/0141789 A1* 10/2002 Terai ..... 399/267
2003/0021614 A1* 1/2003 Takeuchi et al. ..... 399/267
2003/0049053 A1* 3/2003 Kurosu ..... 399/267
2004/0258436 A1* 12/2004 Nakamura et al. ..... 399/277
2005/0220508 A1 10/2005 Masubuchi
2006/0037501 A1 2/2006 Masubuchi
2007/0008395 A1 1/2007 Masubuchi et al.
2008/0150543 A1 6/2008 Masubuchi et al.

FOREIGN PATENT DOCUMENTS

JP S57-167452 4/1981
JP S58-157344 10/1983
JP S59-26374 7/1984
JP S60-7444 3/1985
JP 2002-287505 10/2002

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A development device configured to develop a latent image with developer including toner and carrier includes a development roller configured to carry the developer. The development roller includes a stationary magnet-fixing member, a plurality of magnets fixed to an interior of the stationary magnet-fixing member to form a plurality of magnetic poles, and a cylindrical rotatable sleeve roller configured to revolve coaxially around the exterior of the magnet-fixing member. Magnetic force distribution of a portion of the plurality of magnetic poles is varied in an axial direction of the development roller at positions corresponding to an image forming area in the axial direction of the development roller, enabling the development device to transport and agitate the developer.

16 Claims, 6 Drawing Sheets

MAGNETIC ROLLER, DEVELOPMENT DEVICE, AND IMAGE FORMING METHOD

CROSS-REFERENCE TO RELATED APPLICATIONS

This patent specification claims priority from Japanese Patent Application Nos. 2007-282909, filed on Oct. 31, 2007, and 2008-199211, filed on Aug. 1, 2008 in the Japan Patent Office, the entire contents of each of which are hereby incorporated by reference herein.

BACKGROUND OF THE INVENTION

1. Field of the Invention

The present invention generally relates to a development device used in an image forming apparatus such as a copier, a printer, a plotter, and a facsimile machine, and to an image forming method.

2. Discussion of the Background

In general, an electronographic image forming apparatus, for example, a copier, a printer, a facsimile machine, etc., includes an image forming mechanism for forming an electrostatic latent image, developing the latent image with toner, transferring the developed image onto a recording medium, and fixing the image thereon.

To develop the latent image, magnetic brush development devices are widely used.

A magnetic brush development roller is not conventionally equipped with an ability to transfer and agitate developer in an axial direction of the roller.

By contrast, in one known technique, by forming magnetic poles on a magnetic roller in a spiral, a magnetic brush development roller is provided with an ability to transfer developer in an axial direction of the magnetic roller.

However, this technique cannot be applied to a magnetic roller including a stationary magnet as is because it presupposes that the magnet revolves. If such a spiral structure is used in the magnetic roller including the stationary magnet, which is the most common type of magnetic roller, the quantity of the developer adhered to the magnetic roller becomes uneven in an axial direction thereof in a main polarity (or development polarity), which is undesirable.

SUMMARY OF THE INVENTION

In view of the foregoing, one illustrative embodiment of the present invention provides a development device configured to develop a latent image with developer including toner and carrier and including a development roller configured to carry the developer, with the development roller comprising a stationary magnet-fixing member, a plurality of magnets fixed to an interior of the stationary magnet-fixing member to form a plurality of magnetic poles, and a cylindrical rotatable sleeve roller configured to revolve coaxially around an exterior of the magnet-fixing member, wherein magnetic force distribution of a portion of the plurality of magnetic poles is varied in an axial direction of the development roller at positions corresponding to an image forming area in the axial direction of the development roller.

Another illustrative embodiment of the present invention provides a development roller that is included in the development device described above.

Another illustrative embodiment of the present invention provides an image forming method including forming an electrostatic latent image on an image carrier, agitating and transferring developer including toner and carrier inside a development device in an axial direction of a development roller, pumping up the developer unevenly onto the development roller at a magnetic pole whose magnetic force distribution is varied in the axial direction of the development roller at positions corresponding to an image forming area, transporting the developer in a circumferential direction of the development roller, equalizing the developer pumped up onto the development roller at a magnetic pole whose magnetic force distribution is uniform, and developing the latent image with the toner transferred onto the image carrier from the development roller.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
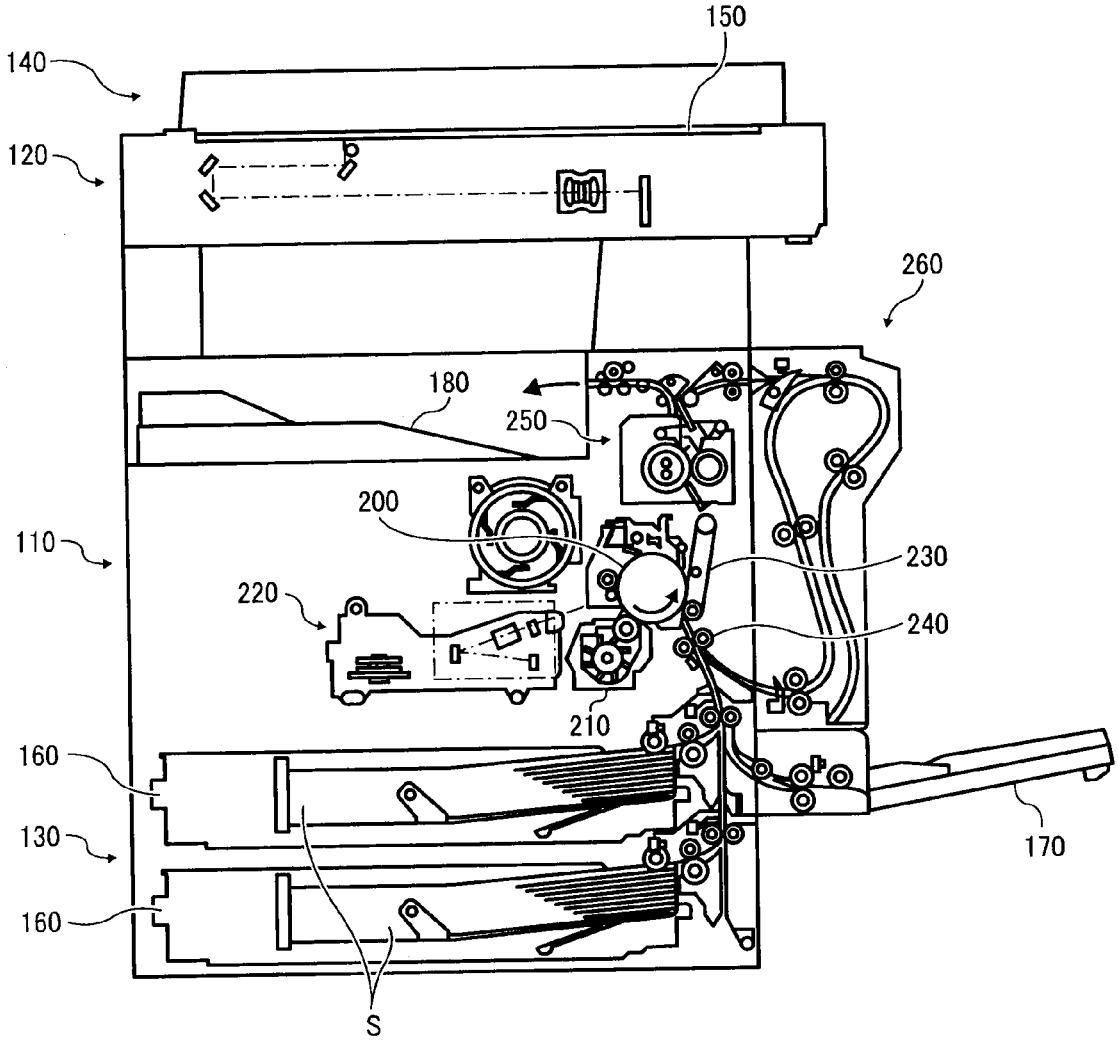
FIG. 1 is an overall schematic view illustrating an example of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein identical reference numerals designate identical or corresponding parts throughout the several views thereof, and particularly to FIG. 1, an image forming apparatus according to an illustrative embodiment of the present invention is described. FIG. 1 is a schematic view illustrating an example of the image forming apparatus according to an illustrative embodiment of the present invention, which in this instance is a copier. It is to be noted that present invention is not restricted to the image forming apparatus shown in drawings but is applicable to various types of image forming apparatuses.

Referring to FIG. 1, reference numeral 110 indicates an image formation unit, reference numeral 120 indicates a scanner, reference numeral 130 indicates a sheet feeder that stores and feeds a transfer sheet S, reference numeral 140 indicates a pressing plate (or a document feeder), and reference numeral 150 indicates a contact glass. It is to be noted that, in this specification, a transfer sheet includes not only paper but also any material used as a storage medium onto which images are transferred in image forming apparatuses, such as an overhead projector (OHP) sheet, etc.

The sheet feeder 130 includes a pair of automatic sheet feed trays 160, and a manual sheet tray 170. Reference numeral 180 indicates a sheet discharger. Reference numeral 200 indicates a photoreceptor unit including a photosensitive drum as a toner image carrier, on which an electrostatic latent image is formed, and a development device 210 to develop the latent image, an optical unit 220, a transfer and transport belt 230, a pair of registration rollers 240, a heat fixing device 250, and a reverse transport unit 260 are located around the photoreceptor unit.

As configurations and operations of the components of the copier are commonly known, descriptions thereof are omitted.

Figure 2:
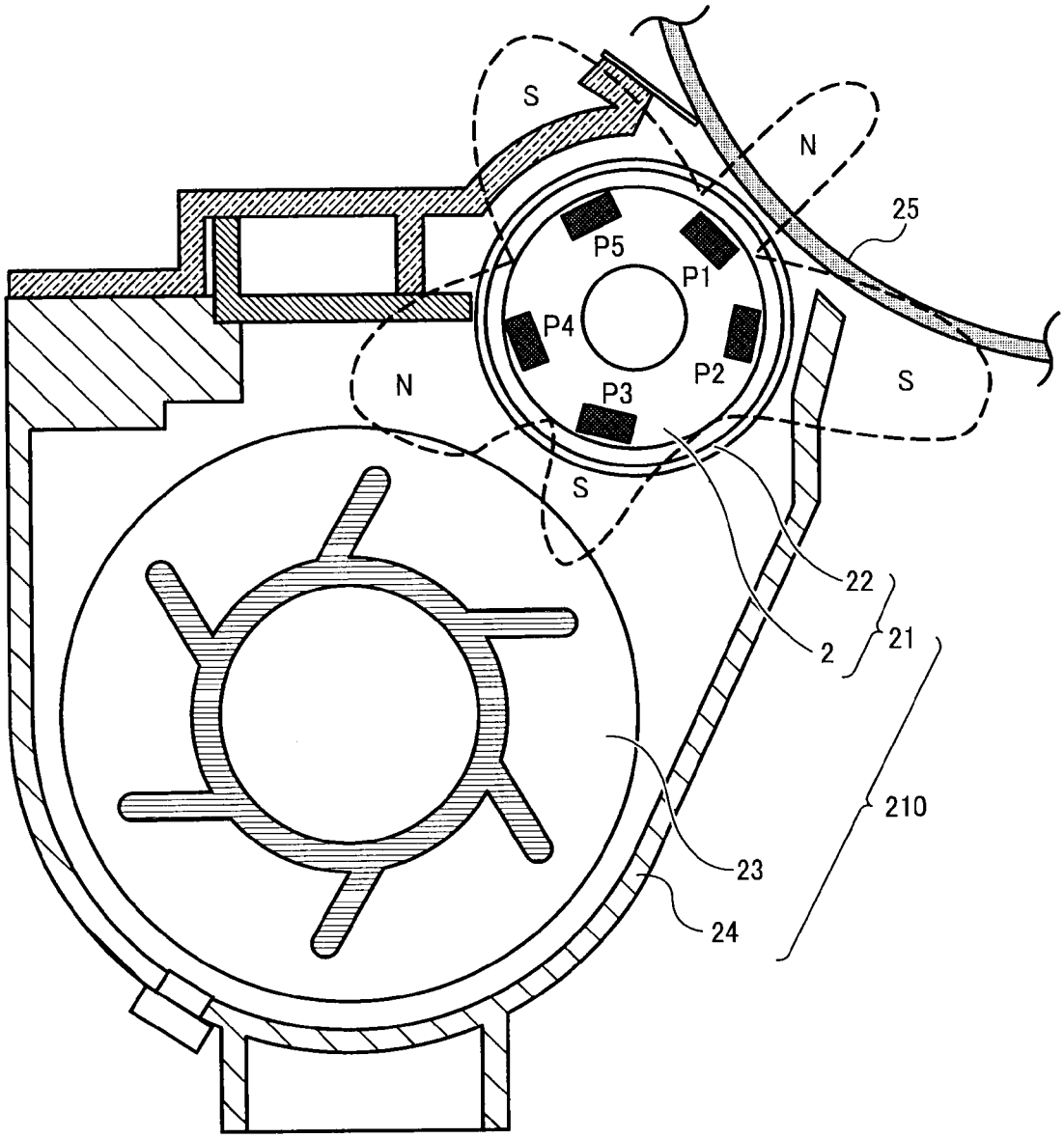
FIG. 2 is a cross-sectional view of a development device.

Referring to FIG. 2, in the development device 210, a development roller 21 is provided in close proximity to a photoreceptor drum 25 as an image carrier, and in an area in which the development roller 21 faces the photoreceptor 25 a development range is formed because of the photoreceptor 25 contacting a magnetic brush. The development device 210 contains developer including toner and magnetic carrier.

The development roller 21 includes a stationary magnetic roller 2 serving as a magnet-fixing member and a rotatable sleeve roller 22 disposed outside and around an exterior surface of the stationary magnetic roller 2. Multiple magnets forming multiple magnetic poles are fixed to an interior surface of the magnetic roller 2. The sleeve roller 22 is cylindrical and is made of nonmagnetic materials such as aluminum, brass, stainless steel, conductive resin, etc. By a roller mechanism, not shown, the sleeve roller 22 is rotated around the magnetic roller 2 clockwise in FIG. 2.

Further, in an area opposite the side of the development roller 21 on which the photoreceptor drum 25 is disposed, an agitation and transport member 23 that includes a revolving screw and a fin is provided in order to pump up the developer in a casing 24 onto the development roller 21 while agitating and transporting the developer in an axial direction (that is, toward a front side of the plane of the sheet of paper on which FIG. 2 is drawn). It is to be noted that the shape of the magnetic fixing member is not restricted to a roller, but may be any, shape, such as polygonal columnar, that does not hinder rotation of the sleeve roller.

Figure 3A:
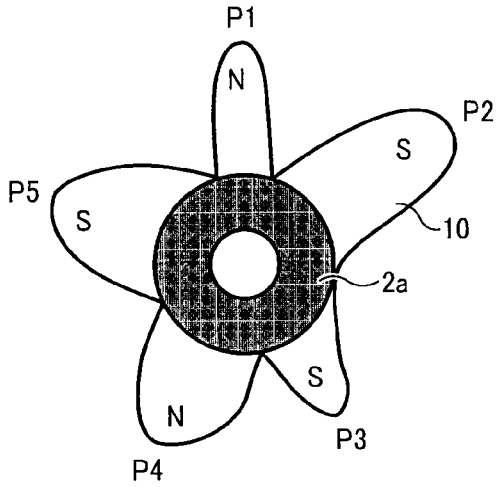
FIG. 3A is a cross-sectional diagram illustrating an example of magnetic force distribution in a competitive five-pole magnetic roller.

FIG. 3A is a schematic view illustrating magnetic distribution (distribution of magnetic force) 10 in a five-pole magnetic roller 2*a* as a comparative example. In FIG. 3A, reference character Pi, which represents a main magnetic pole, and magnetic poles P2 through P5 are arranged clockwise. The main magnetic pole is a magnetic pole that transfers toner from the development roller to the image carrier to form an image. It is to be noted that, although not shown, a sleeve roller, which is usually made from nonmagnetic materials, is rotatably provided around the magnetic roller 2*a* coaxially with the magnetic roller 2*a*, and the magnetic roller 2*a* and the sleeve roller together form the development roller 21.

The sleeve roller is rotated clockwise in FIG. 3A and pumps the developer up from a developer pool of a development device, not shown, onto the development roller in magnetic pole P4. Distribution of the developer is adjusted by using a developer regulation member such as a doctor blade, not shown, positioned at the location of the magnetic pole P5, so that an image is formed on the surface of a photoreceptor that faces the magnetic pole P1. Then, between the magnetic poles P2 and P3, the developer leaves the development roller and returns to the developer pool.

In the present embodiment, in contrast to the above-mentioned comparative example, only some of the magnetic poles vary in strength of magnetic distribution axially. That is, in the example shown in FIG. 3A, a part of the magnetic pole means at least one of five magnetic poles. More specifically, "a part of the magnetic pole" means at least one of the magnetic poles exclusive of the main pole PA1.

Figure 3B:
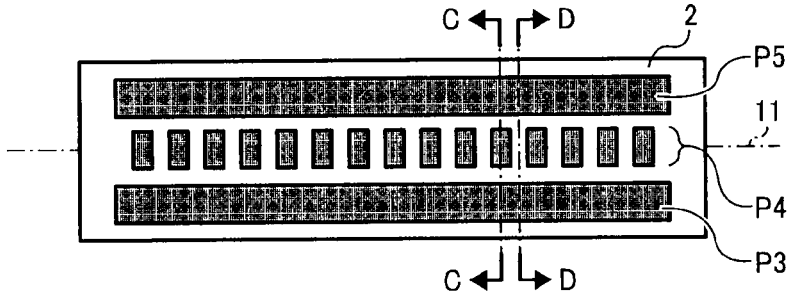
FIG. 3B is a diagram illustrating a magnetic roller included in the development device shown in FIG. 2 as viewed from the side of a developer pool.

FIG. 3B is a diagram illustrating the magnetic roller 2 shown in FIG. 2 as viewed from the side of the developer pool. In FIG. 3B, dark areas show strong magnetic force (the magnetic force is particularly strong to a normal line direction). As shown in FIG. 3B, in the magnetic pole P4 that pumps the developer up, magnetic force is distributed along a magnetic roller axis 11, which can be formed by multiple magnets arranged in the direction thereof.

Figure 3C:
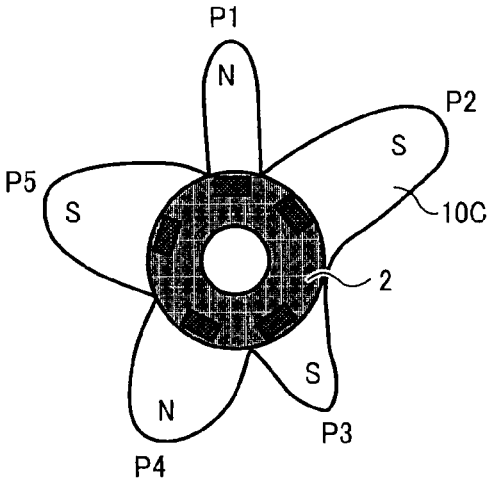
FIG. 3C is a cross-sectional diagram illustrating the magnetic roller shown in FIG. 3B at the position indicated by a dashed line C in FIG. 3B and illustrating magnetic force distribution thereof in a circumferential direction of the magnetic roller.
Figure 3D:
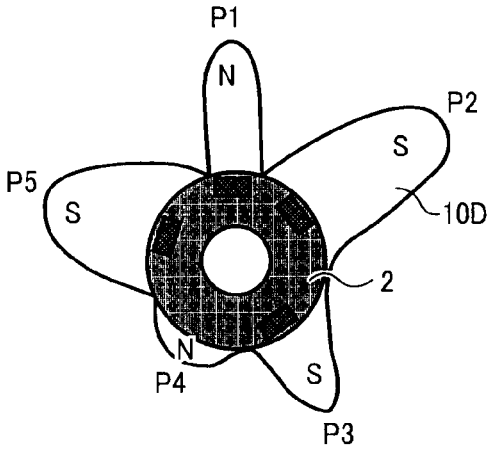
FIG. 3D is a cross-section diagram illustrating the magnetic roller shown in FIG. 3B at the position indicated by a dashed line D in FIG. 3B and illustrating magnetic force distribution thereof in the circumferential direction of the magnetic roller.

Magnetic force distribution can be described in more detail using FIGS. 3C and 3D. FIGS. 3C and 3D are cross-sectional diagrams of the magnetic roller 2 at the positions indicated by dashed lines C and D in FIG. 3B, respectively, and show magnetic force distributions 10C and 10D in respective positions of the magnetic roller 2 in a circumferential direction. Thus, a relatively weak magnetic force is present at the magnetic pole P4 at the position indicated by the dashed line C, whereas in the magnetic distribution 10C shown in FIG. 3C the magnetic pole P4 has a relatively large value of flux density peak, for example, 60 mT.

By contrast, because the position indicated by the dashed line D is located circumferentially between two weak magnetic poles, in the magnetic force distribution 10D shown in FIG. 3D, the magnetic pole P4 has a relatively small value of flux density peak, for example, about 10 mT. In the magnetic distribution 10C and 10D respectively shown in FIGS. 3C and 3D, the magnetic flux density peaks are different in the magnetic pole P4, that is, the peak value is about 50 mT in FIG. 3C but about 10 mT in FIG. 3D.

In the configuration described above, as the sleeve roller 22 is rotated, after the developer is pumped up in magnetic pole P4, a wavy developer distribution that is banked in a saddle-shape according to the areas of strong magnetic force appears. Then, the developer is flattened around the magnetic pole P5, and is sent to the magnetic pole P1. By being banked and flattened, the developer is agitated.

It is to be noted that each of the magnetic force distributions 10C an 10D shown in FIGS. 3C and 3D is a schematic view illustrating results obtained when the magnetic flux density on the magnetic roller surface in the normal line direction is measured by a Hall element along the circumference of the magnetic roller 2.

The "magnetic force" used in this specification indicates two types of force: The force of a magnet to aspirate magnetic carrier particles in the developer and the force with which magnetic carrier particles, which are magnetized by the magnetic field generated by the magnet, attract each other. The former is proportional to the space gradient of the magnetic flux density according to the carrier position, and the latter is proportional to the magnetic flux density according to the carrier position. If only a single magnetic carrier particle exists, the former is dominant, but when the quantity and density of the magnetic carrier particles are so great as to form a magnetic brush, the latter is dominant.

The present invention is directed to a relatively large amount of magnetic carrier particles whose density is relatively high. Therefore, in this specification, "magnetic force distribution" can be replaced with "distribution of the force proportional to the magnetic flux density" or just "magnetic flux density". Similarly, "the area in which magnetic force is strong" can be replaced with "the area in which the magnetic flux density is high".

Figure 4A:
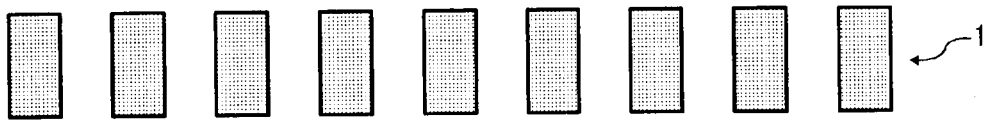
FIGS. 4A, 4B, 4C, and 4D are diagrams illustrating examples of distribution patterns of magnetic force viewed from a surface of the magnetic roller shown in FIG. 2.
Figure 4B:
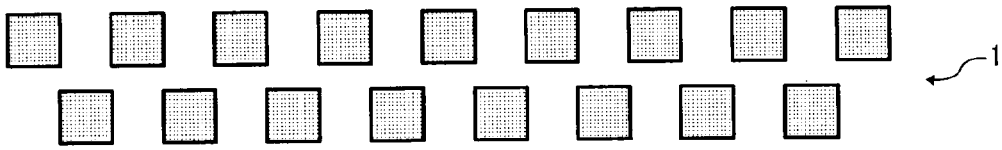

FIGS. 4A, 4B, 4C and 4D are diagrams that show examples of distribution patterns of magnetic force in the magnetic pole P4 along a line 11 shown in FIG. 3B. Reference numeral 1 in FIGS. 4A through 4D, represents the strong magnetic force areas in a normal line direction. The magnetic force distribution pattern shown in FIG. 4A has an agitating function, as described above with reference to FIG. 3B. In FIG. 4B, by changing the position on which developer is banked, the agitating function is enhanced.

Figure 4C:
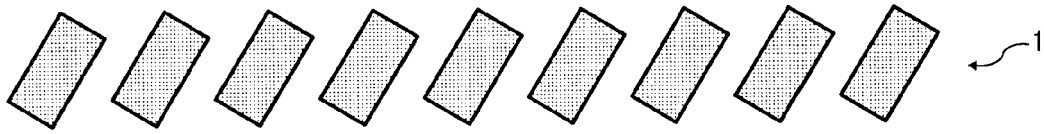

FIG. 4C shows a pattern that is a part of a spiral, which means that, if the pattern is extended vertically upward and downward, it becomes a spiral. This pattern may be called simply "an oblique pattern". In this pattern, for example, when the sleeve roller 22 moves upward in FIG. 4C, the developer moves rightward while moving upward, and thus it has the function to transfer the developer in the axial direction of the magnetic roller shown in FIG. 3B.

Figure 4D:
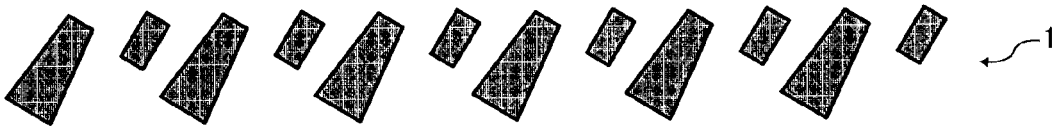

FIG. 4D shows an example that the nearer the main magnetic pole, the smaller the repeat cycle in the axial direction of the magnetic distribution pattern, which represents a case that the main magnetic pole exists in an upper portion in FIG. 4D. Because the pattern shown in FIG. 4D is an oblique pattern, like as the pattern shown in FIG. 4C, it has the function to transfer the developer in the axial direction of the magnetic roller shown in FIG. 3B. Further, in the upper portion in FIG. 4D that is near the magnetic pole P1, the pattern repetition cycle is about half a pattern repetition cycle in a lower portion in FIG. 4D. It is to be noted that each of these patterns is repeated in the axial direction of the magnetic roller.

Further, although FIGS. 4A through 4D show constant cycle examples, alternatively cyclic intervals may be inconstant. Moreover, although in FIGS. 3B and 3C the strength of the magnetic force is represented by the dark areas, alternatively a pattern in which magnetic polarities alternate is possible.

Therefore, according to the present embodiment, a magnetic brush-type development roller including a stationary magnetic roller can transport and agitate the developer. Moreover, the development roller can better control unevenness of a quantity of the developer adhered to the development roller in a main magnetic pole than the conventional development roller that does not have the ability to transport and agitate does.

Magnetic distribution according to another embodiment is described below with reference to FIGS. 5A through 5E. FIGS. 5A through 5E illustrate relations between arrangement of magnets forming magnetic poles and distribution of the developer according to another embodiment of present invention. Examples of magnets arrangement patterns in the magnetic pole P4 (pump-up pole), for example, are described below with reference to FIGS. 5A through 5E.

Figure 5A:
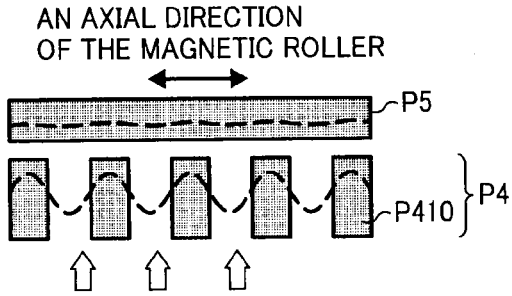
FIGS. 5A through 5E are diagrams illustrating relations between particular arrangements of magnets forming magnetic poles and distribution of the developer according to another embodiment of the present invention.

Referring to FIG. 5A, the magnetic pole P5 has a uniform magnetic force distribution in the axial direction of the magnetic roller, and the magnetic pole P4 is formed by multiple small magnets P410 localized in the axial direction of the roller and includes multiple weak magnetic poles. The configuration and direction of the small magnets P410 are not limited to specific examples. It is to be noted that, in FIG. 5A, dashed lines show distribution of the developer in the respective magnetic poles, and it can be seen that the amount of the developer is larger in convexities on the dashed lines. Further, upward arrows indicate directions in which developer moves (in the direction in which the sleeve roller revolves). These points are applicable to FIGS. 5B through 5E as well as FIG. 5A. In this example, when the developer is pumped up, the developer pumped up is gathered in each magnetic pole formed by each of small magnets P410, and thus the developer is unevenly distributed in the axial direction of the roller. Subsequently, when the developer passes through the magnetic pole P5, distribution of the developer is flattened in the axial direction of the roller. Therefore, agitating the developer, in other words, equalizing a toner concentration therein at least in the axial direction of the roller, and charging the toner are achieved.

Figure 5B:
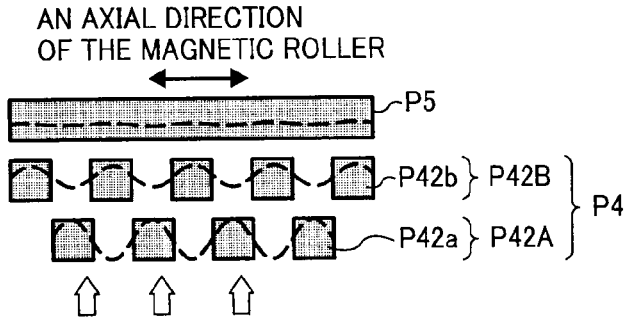

In FIG. 5B, the small magnets P410 forming the magnetic pole P4 in the pattern shown in FIG. 5A are respectively partitioned at least into two alternating rows, an upstream line of small magnets P42*a* forming a magnetic pole P42A and a downstream line of small magnets P42*b* forming a magnetic pole P42B in the sub-scanning direction. While the developer is pumped up, the developer pumped up is gathered around the magnetic pole P42A formed by upstream small magnets P42*a*. Subsequently, when the developer passes through the magnetic pole P42B, the developer is moved reciprocally to and fro in the axial direction of the roller toward weak magnetic poles P42B formed by each small magnets P42*b*. Ultimately, when the developer passes through the magnetic pole P5, the developer is flattened in the axial direction of the roller. The effect of agitating the developer of the pattern shown in FIG. 5B is larger than that of the pattern shown in FIG. 5A.

Figure 5C:
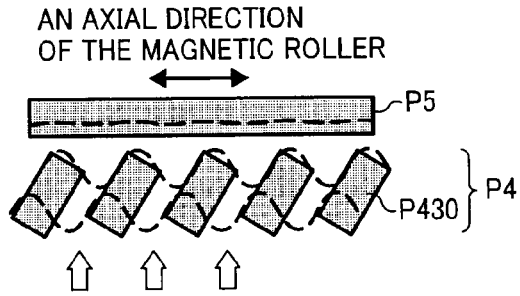

FIG. 5C shows a pattern in which each of small magnets P410 in the magnetic pole P4 in the pattern shown in FIG. 5A is a part of a spiral, that is, small magnets P430 in the magnetic pole P4 are strips that are arranged obliquely to the circumferential direction of the magnetic roller. Although the developer is agitated in a similar manner to that of the pattern shown in FIG. 5A, because each small magnet P430 is a strip that is arranged obliquely to the circumferential direction, the developer moves to the right in FIG. 5C as the sleeve roller 22 revolves, as indicated by two dashed lines at the magnetic pole P4. In FIG. 5C, in addition to the effect of agitating the developer that the pattern shown in FIG. 5A achieves as well, the effect of transferring the developer in the axial direction of the roller is generated.

Figure 5D:
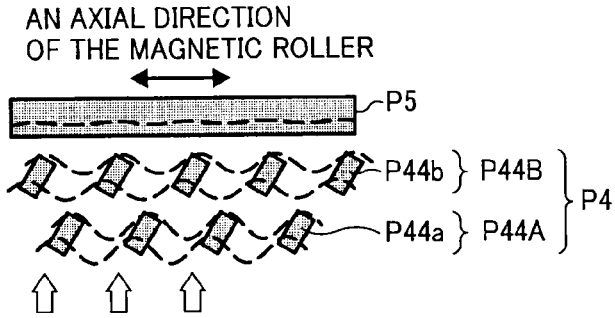

FIG. 5D shows a pattern in which each small magnet P42*a* and P42*b* forming the magnetic pole P4 in the pattern shown in FIG. 5B is a part of spiral. Although the developer is agitated in a similar manner to that of the pattern shown in FIG. 5B, because small magnets P44*a* forming a magnetic pole P44A and small magnets P44*b* forming a magnetic pole P44B are strips that are arranged obliquely to the circumferential direction, the developer moves to the right in FIG. 5D, as the sleeve roller revolves.

The pattern shown in FIG. 5D can achieve the effect of transferring the developer similarly to the pattern shown in FIG. 5C, and the effect of agitating the developer is higher than that of the pattern shown in FIG. 5C.

Figure 5E:
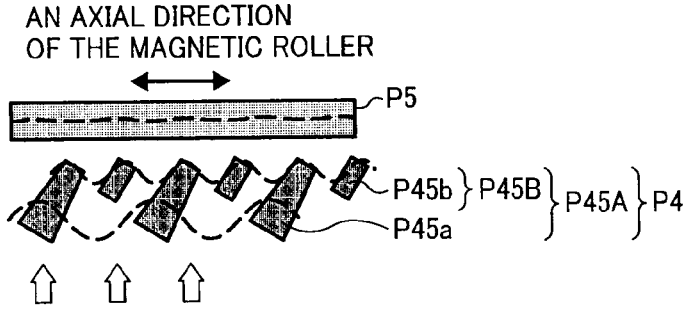

In FIG. 5E, the small magnets P44*a* forming the magnetic pole P44A in the pattern shown in FIG. 5D are larger than the small magnets P44*b* forming the magnetic pole P44B, and they are tapered. The position in the sub-scanning direction of tip portions of small magnets P45*a* forming the magnetic pole P45A overlaps the position of a magnetic pole P45B formed by weak magnetic poles P45*b*. Further, each small magnet P45*a* forming the magnetic pole P45A is tapered so that the side near a main magnetic pole (located above a magnetic pole P5 in FIG. 5E) is thinner.

In this example, although the developer is agitated in a similar manner to that of the patterns shown in FIG. 5D, when the developer is pumped up, the force of pumping up the developer by thicker tip portions of the tapered small magnets P45*a* forming the magnetic pole P45A is stronger than that by the small magnets P44*b* in the pattern shown in FIG. 5D. Then, downstream in the direction in which the developer moves (in the direction in which the sleeve roller revolves), because the small magnets P45*a* are thinner and arranged into line with the small magnets P45*b*, the arrangement cycle of the small magnets in the axial direction of the roller is similar to or smaller than that of the pattern shown in FIG. 5D.

Then, the pattern shown in FIG. 5E can achieve the effect of transferring the developer and the effect of agitating the developer similarly to the pattern shown in FIG. 5D, and the amount of the developer pumped up is larger than that of the pattern shown in FIG. 5D. Further, because the arrangement cycle of the small magnets is smaller on the downstream side in the magnetic pole P4 in the direction in which the developer moves, it is easily possible to equalize the developer amount, and the magnetic force distribution itself has a smaller effect on the main magnetic pole.

Alternatively, an arrangement in which the small magnets P45*a* forming the magnetic pole P45A and the small magnets P45*b* forming the magnetic pole P45B are arranged not obliquely to the circumferential direction but straight along the sub-scanning direction can be adopted. In other words, a tapered version of the pattern shown in FIG. 5B can be adopted.

Figure 6A:
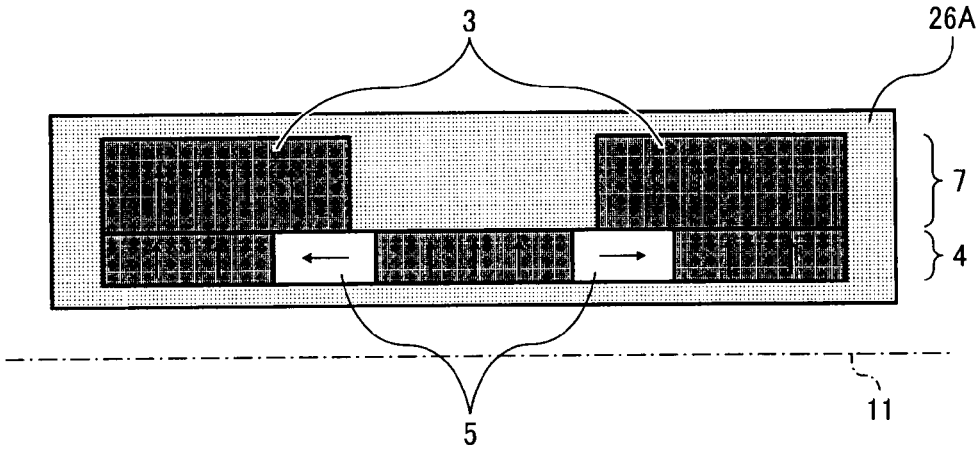
FIGS. 6A and 6B are cross-sectional diagrams illustrating buffer layers of magnetic rollers according to another embodiment of the present invention.
Figure 6B:
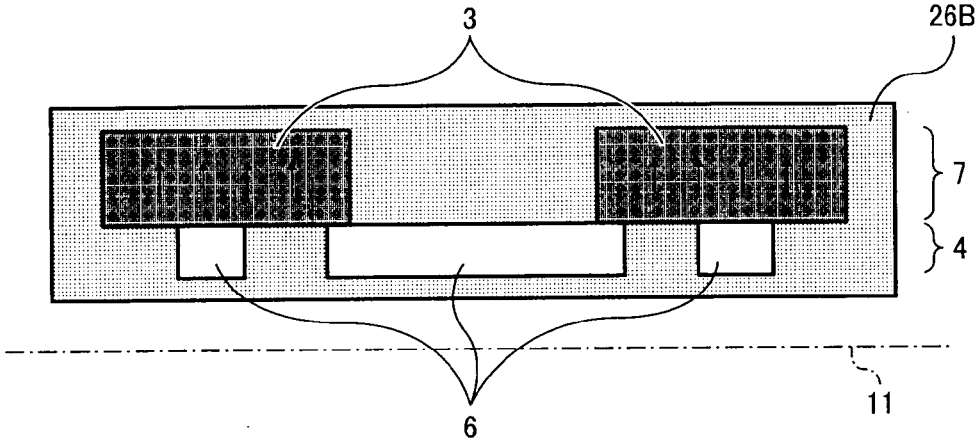

FIGS. 6A and 6B are sectional diagrams illustrating buffer layers in magnetic rollers 26A and 26B according to another embodiment of present invention, which become visible when a part of cylindrical magnetic rollers 26A and 26B are cut out. In FIG. 6A, reference numeral 5 indicates magnets whose lines of magnetic force are straight or substantially straight in an axial direction of the magnetic roller. In FIG. 6B, reference numeral 6 indicates a high magnetic permeability member, made of a material having a relatively high magnetic permeability.

In each of FIGS. 6A and 6B, in a magnetic layer 7 forming a magnetic pole, multiple magnets 3 whose lines of magnetic force are vertical or substantially vertical to the axial direction of the magnetic roller are arranged in the axial direction, which forms a magnetic distribution pattern similar to the configurations shown in FIGS. 4A through 4D, for example. On a lower part of the magnetic layer 7, a buffer layer 4 is provided, which discourages magnetic distribution in the axial direction of the magnetic roller similar to the distribution pattern shown in FIG. 4A through 4D from being transmitted to the interior of the magnetic roller 26A or 26B.

Two types of configurations are conceivable regarding the buffer layer 4, each of which is described below.

In one type, as shown in FIG. 6A, since a large number of small magnets whose lines of magnetic force are straight or substantially straight to the axial direction of the magnetic roller and small magnets whose lines of magnetic force are vertical thereto are combined, magnetic force lines generated in the layer 7 are densely arrayed so that the total area or field of magnetic force is relatively small. In another example, the high magnetic permeability members 6 are provided as shown in FIG. 6B, and this configuration can achieve an effect similar to the effect achieved in the configuration shown in FIG. 6A.

These configurations are more intricate than known magnetic rollers are. However, for example, when a technique of substantially concentrically superposing differently polarized sheet-type magnets like a roll, such as the technique disclosed in Japanese Patent Application No. 2002-287505, the contents of which are hereby incorporated by reference herein, is used, manufacture of at least the configuration shown in FIG. 6A can be comparatively easy.

Figure 7:
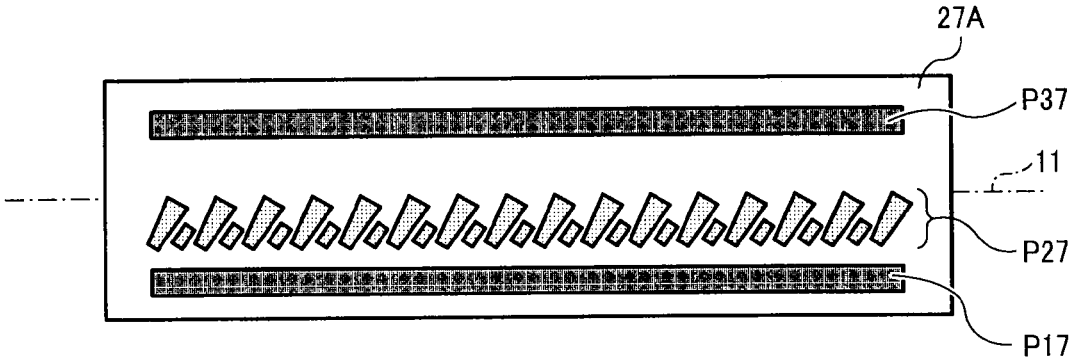
FIG. 7 is a cross-sectional diagram illustrating a magnetic roller according to another embodiment of the present invention.

FIG. 7 is a section diagram illustrating a magnetic roller 27A according to another embodiment of present invention. The magnetic roller 27A according to another embodiment can be used in the development device 210 shown in FIG. 2 instead of the magnetic roller 2 shown in FIG. 3B. In an example shown in FIG. 7, a sleeve roller moves from bottom to top.

Since magnetic force distribution in the axial direction of the magnetic roller exists in a magnetic pole P27 that is located between a main magnetic pole P17 and another magnetic pole P37, the distribution of the developer generated in the magnetic pole P27 dose not affect the main magnetic pole P17. Further, this magnetic pole P27 shown in FIG. 7 can transfer the developer to the axial direction of the magnetic roller.

It is to be noted that the present invention can be embodied as an image forming method including forming an electrostatic latent image on an image carrier, agitating and transferring developer including toner and carrier inside a development device in an axial direction of a development roller, pumping up the developer unevenly onto the development roller at a magnetic pole whose magnetic force distribution is varied in the axial direction in a position corresponding to an image forming area, transporting the developer in a circumferential direction of the development roller, equalizing the developer pumped up onto the development roller at a magnetic pole whose magnetic force distribution is uniform, and developing the latent image with the toner transferred onto the image carrier from the development roller.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device configured to develop a latent image with developer including toner and carrier and including a development roller configured to carry the developer, the development roller comprising:

a stationary magnet-fixing member;

a plurality of magnets fixed to an interior of the stationary magnet-fixing member to form a plurality of magnetic poles; and a cylindrical rotatable sleeve roller configured to revolve coaxially around an exterior of the magnet-fixing member, wherein magnetic force distribution of a portion of the plurality of magnetic poles is varied in an axial direction of the development roller at positions corresponding to an image forming area in the axial direction of the development roller, and wherein the portion of the plurality of magnetic poles whose magnetic force distribution is varied in the axial direction is located downstream from a main magnetic pole of the plurality of magnetic poles in a direction in which the sleeve roller revolves.

2. The development device according to claim 1, wherein a pattern of the magnetic force distribution of the portion of the plurality of magnetic poles varied in the axial direction forms a spiral.

3. The development device according to claim 1, wherein a buffer layer is provided in the portion of the plurality of magnetic poles whose magnetic force distribution is varied in the axial direction, the buffer layer being disposed closer to a development roller axis than a layer that causes the magnetic force distribution to vary in the axial direction.

4. The development device according to claim 1, wherein the main magnetic pole transfers the toner from the development roller to an image carrier to form an image, the main magnetic pole being excluded from the portion of the plurality of magnetic poles whose magnetic force distribution is varied in the axial direction, a repetition cycle of the pattern of the magnetic force distribution in the axial direction contracting as a distance to the main magnetic pole decreases.

5. The development device according to claim 1, wherein the magnet-fixing member on which the plurality of magnets is fixed is formed into a roller and the sleeve roller comprises a non-magnetic material.

6. The development device according to claim 1, further comprising an agitation and transport member located on a side of the development roller opposite the side facing an image carrier and configured to pump up the developer onto the development roller while agitating and transporting the developer, wherein the development roller is provided in close proximity to the image carrier, and a development range is formed because of the image carrier contacting a magnetic brush where the development device faces the image carrier.

7. The development device according to claim 6, wherein the plurality of magnetic poles includes a magnetic pole whose magnetic force distribution is uniform and a pump-up pole that pumps up the developer, the pump-up pole is formed by a plurality of small magnets arrayed in the axial direction, and magnetic force distribution of the pump-up pole is varied in the axial direction.

8. The development device according to claim 7, wherein the small magnets forming the pump-up pole are partitioned into at least two alternating upstream and downstream lines of small magnets in a sub-scanning direction, the developer pumped up is gathered around an upstream magnetic pole formed by each of the upstream small magnets, and then moves reciprocally to and fro in the axial direction toward a downstream magnetic pole formed by each of the downstream small magnets, and when the developer passes through the magnetic pole whose magnetic force distribution is uniform, the developer is flattened in the axial direction.

9. The development device according to claim 7, wherein each of the small magnets forming the pump-up pole is a strip arranged obliquely to a circumferential direction of the development roller, and moves and agitates the developer as the sleeve roller revolves.

10. The development device according to claim 7, wherein the small magnets forming the pump-up pole are arranged in strips obliquely to the axial direction, and configured to transfer the developer as the sleeve roller revolves.

11. The development device according to claim 7, wherein the small magnets forming the pump-up pole comprise a plurality of tapered magnets and a plurality of non-tapered magnets that are smaller than the plurality of tapered magnets, a tapered, thin tip portion of the each of the tapered magnets on a side near the main magnet pole overlaps the non-tapered magnets in a sub-scanning direction, and an arrangement cycle of the small magnets in the axial direction is shorter on a downstream side of the tapered magnets in the direction, in which sleeve roller revolves than on an upstream side, a non-tapered, thicker tip portion of each of the tapered magnets forming the pump-up pole provides stronger pumping action.

12. The development device according to claim 11, wherein the tapered small magnets are disposed straight in the sub-scanning direction, and an arrangement cycle of the small magnets in the axial direction is shorter on a downstream side in the pump-up pole in the direction in which sleeve roller revolves than on an upstream side to equalize distribution of the developer.

13. The development device according to claim 1, incorporated into an image forming apparatus comprising an image carrier configured to carry a toner image.

14. A development roller, comprising:

a stationary magnet-fixing member;

a plurality of magnets fixed to an interior of the stationary magnet-fixing member to form a plurality of magnetic poles; and a cylindrical rotatable sleeve roller configured to revolve coaxially around an exterior of the magnet-fixing member, wherein magnetic force distribution of a portion of the plurality of magnetic poles is varied in an axial direction of the development roller in a position corresponding to an image forming area in the axial direction of the development roller, and wherein the portion of the plurality of magnetic poles whose magnetic force distribution is varied in the axial direction is located downstream from a main magnetic pole of the plurality of magnetic poles in a direction in which the sleeve roller revolves.

15. The development roller according to claim 14, wherein the magnet-fixing member is formed into a roller.

16. An image forming method comprising:

forming an electrostatic latent image on an image carrier;

agitating and transferring developer including toner and carrier inside a development device in an axial direction of a development roller, the development device including a plurality of magnets fixed to an interior of a stationary magnet-fixing member to form a plurality of magnetic poles;

pumping up the developer unevenly onto the development roller at a magnetic pole whose magnetic force distribution is varied in the axial direction of the development roller in a position corresponding to an image forming area;

transporting the developer, via a sleeve roller, in a circumferential direction of the development roller;

equalizing the developer pumped up onto the development roller at a magnetic pole whose magnetic force distribution is uniform; and developing the latent image with the toner transferred onto the image carrier from the development roller, wherein the magnetic pole whose magnetic force distribution is varied in the axial direction is located downstream from a main magnetic pole of the plurality of magnetic poles in a direction in which the sleeve roller revolves.

* * * * *